US005483811A

United States Patent [19]

Miller

[11] Patent Number: 5,483,811

[45] Date of Patent: Jan. 16, 1996

[54] SEGMENTED ANVIL ROLLER FOR REFINING THE DOMAIN STRUCTURE OF ELECTRICAL STEELS

[75] Inventor: Robert F. Miller, Evans City, Pa.

[73] Assignee: Alleghney Ludlum Corporation, Pittsburgh, Pa.

[21] Appl. No.: 378,893

[22] Filed: Jan. 25, 1995

Related U.S. Application Data

[63] Continuation of Ser. No. 977,359, Nov. 17, 1992, abandoned.

[51] Int. Cl.[6] ..... B21B 27/02

[52] U.S. Cl. ..... 72/197; 72/252.5; 492/39

[58] Field of Search ..... 72/194, 197, 199, 72/201, 252.5, 365.2, 366.2, 379.6; 148/111, 120; 492/4, 5, 30, 39

[56] References Cited

U.S. PATENT DOCUMENTS

| | | | |
|---|---|---|---|
| 3,217,387 | 11/1965 | Strindlund | 492/39 |
| 3,253,323 | 5/1966 | Saueressig | 492/39 |
| 4,533,409 | 8/1985 | Benford | 148/111 |
| 4,614,632 | 9/1986 | Kezuka et al. | 492/30 |
| 4,711,113 | 12/1987 | Benford | 72/197 |
| 4,742,706 | 5/1988 | Sasaki et al. | 72/241 |
| 4,770,720 | 9/1988 | Kobayashi et al. | 148/111 |
| 5,080,326 | 1/1992 | Price et al. | 266/103 |
| 5,123,977 | 6/1992 | Price et al. | 148/111 |

FOREIGN PATENT DOCUMENTS

| | | | |
|---|---|---|---|
| 2356243 | 1/1975 | Germany | 72/197 |
| 1203629 | 8/1970 | United Kingdom | 492/5 |

*Primary Examiner*—Lowell A. Larson
*Assistant Examiner*—Thomas C. Schoeffler
*Attorney, Agent, or Firm*—Patrick J. Viccaro

[57] ABSTRACT

A method and apparatus are provided for refining the domain wall spacing of a grain-oriented silicon steel sheet by mechanical scribing using a segmented anvil roller and a scribing roll. The segments of the anvil roll are arranged side by side along an arbor. The arbor carries inflatable bladder ribs along the length of the arbor to provide uniform contact pressure to the strip during scribing at the opposite side of the strip by the scribing roll.

8 Claims, 2 Drawing Sheets

SEGMENTED ANVIL ROLLER FOR REFINING THE DOMAIN STRUCTURE OF ELECTRICAL STEELS

This is a continuation of application Ser. No. 07/977,359, filed Nov. 17, 1992, now abandoned.

CROSS REFERENCE TO RELATED APPLICATIONS

This application is related to U.S. patent application Ser. No. 07/977,584, filed Nov. 17, 1992; Ser. No. 07/978,204, filed Nov. 17, 1992; Ser. No. 07/978,202, filed Nov. 17, 1992; Ser. No. 07/977,345, filed Nov. 17, 1992; and Ser. No. 07/977,595, filed Nov. 17, 1992.

BACKGROUND OF THE INVENTION

1. Field of the Invention

This invention relates to a method and apparatus for improving core loss by refining the magnetic domain wall spacing of electrical sheet or strip product. More particularly, this invention relates to refining a final texture annealed grain-oriented silicon steel strip by using a segmented anvil roller to support the strip product while an oppositely disposed scribing roll is pressed against the strip to cause uniform local mechanical deformation across the width of the strip product.

2. Description of the Prior Art

Grain-oriented silicon steel is conventionally used in electrical applications, such as power transformers, distribution transformers, generators, and the like. The steel's ability to permit cyclic reversals of the applied magnetic field with only limited energy loss is a most important property. A reduction of this loss, which is termed "core loss", is highly desirable in the aforesaid electrical applications.

In the manufacture of grain-oriented silicon steel, it is known that the Goss secondary recrystallization texture, (110)[001] in terms of Miller's indices, results in improved magnetic properties, particularly permeability and core loss over non-oriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon; casting the melt; hot rolling; cold rolling the steel to final gauge typically of 7 or 9 mils, and up to 14 mils with intermediate annealing when two or more cold rolling are used; or no intermediate annealing for certain high permeability silicon steel; decarburizing the steel; applying a refractory oxide base coating, such as a magnesium oxide, to the steel; and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein, during recrystallization, secondary cube-on-edge oriented grains are preferentially grown at the expense of primary grains having a different and undesirable orientation.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain-oriented silicon steel; and second, high permeability, grain-oriented silicon steel. Regular, grain-oriented silicon steel is generally characterized by a permeability of less than 1870 at 10 Oersteds. High permeability, grain-oriented silicon steels are characterized by higher permeabilities which may be the result of composition changes alone or together with process changes. For example, high permeability silicon steels may contain nitrides, sulfides, selenides, and/or borides which contribute to the particles of the inhibition system which is essential to the secondary recrystallization process for the steel. Furthermore, such high permeability silicon steels generally undergo greater cold reduction to final gauge than regular grain oriented steels. A heavy final cold reduction on the order of greater than 80% is generally made in order to facilitate the high permeability grain orientation. While such higher permeability materials are desirable, such materials tend to produce larger magnetic domains than conventional material. Generally, larger domains are detrimental to core loss.

It is known that one of the ways that domain size and thereby core loss values of electrical steels may be reduced occurs when the steel is subjected to any one of various practices designed to induce localized strains in the surface of the steel. Such practices may be generally referred to as "domain refining by scribing" and are performed after the final high temperature annealing operation. If the steel is scribed after the final texture annealing, a localized stress state in the texture-annealed sheet is induced so that the domain wall spacing is reduced. These disturbances typically are relatively narrow, straight line patterns, or scribes, generally spaced at regular intervals. The scribe lines are substantially transverse to the rolling direction and typically are applied to only one side of the steel.

In fabricating electrical steels into transformers, the steel inevitably suffers some deterioration in core loss quality due to cutting, bending, and construction of cores during fabrication, all of which impart undesirable stresses in the material. During fabrication incidental to the production of stacked core transformers and, more particularly, power transformers in the United States, the deterioration in core loss quality due to fabrication is not so severe that a stress relief anneal, typically about 1475° F. (801° C.), is essential to restore properties. For such end uses, there is a need for a flat, domain-refined silicon steel which need not be subjected to stress relief annealing. In other words, the scribed steel used for this purpose does not have to possess domain refinement which is heat resistant.

However, during the fabrication incidental to the production of most distribution transformers in the United States, the steel strip is cut and subjected to various bending and shaping operations which produce more working stresses in the steel than in the case of power transformers. In such instances, it is necessary and conventional for manufacturers to stress relief anneal the product to relieve such stresses. During stress relief anneal, it has been found that the beneficial effect on core loss resulting from some scribing techniques, such as mechanical and thermal scribing, are lost. For such end uses, it is required and desired that the product exhibit heat resistant domain refinement in order to retain the improvements in core loss values resulting from scribing.

In referring now to certain prior teaching, U.S. Pat. Nos. 4,533,409, issued Dec. 19, 1984 and 4,711,113, issued Dec. 8, 1987, disclose a method and apparatus for scribing a grain-oriented silicon steel to refine the grain structure by passing the cold strip through a roll pass defined by an anvil roll and scribing roll. The surface of the scribing roll is provided with a plurality of projections extending along and generally parallel to the roll axis. The anvil roll is typically constructed from a material that is relatively more elastic than the material from which the scribing roll is constructed. Preferably, the scribing roll is constructed from steel and the anvil roll is constructed from rubber. The process described in U.S. Pat. No. 4,711,113, may be performed before or after stress relief annealing but the domain refinement achieved is not maintained through the usual stress relief annealing temperatures.

U.S. Pat. No. 4,742,706, issued May 10, 1988, discloses an apparatus for imparting strain to a moving steel sheet at linear spaced-apart, deformation regions. The apparatus includes a strain imparting roll having a plurality of projections as in the above described U.S. Pat. No. 4,711,113, but where the projections are formed on a spiral relative to the axis of rotation of the roll, the apparatus of the '706 patent also includes a press roll, a plurality of back-up rolls and a fluid pressure cylinder interconnected so as to control pressure against the press roll.

U.S. Pat. No. 4,770,720, issued Sep. 13, 1988, discloses a cold deformation technique wherein final texture annealed grain oriented silicon steel at as low as room temperature, and at as high as from 122° F. to 932° F. (50° C. to 500° C.) is subjected to local loading, at a mean load of 90 to 220 kg/mm$^2$ to (127,000 to 325,000 PSI) to form spaced apart grooves. The sheet must then be annealed at 1380° F. (750° C.) or more so that fine recrystallized grains are formed to divide the magnetic domains and improve core loss values which survive subsequent stress relief annealing.

In U.S. Pat. Nos. 5,080,326, issued Jan. 14, 1992 and 5,123,977, issued Jun. 23, 1992 and assigned to the same assignee of this patent application, a hot deformation technique is disclosed wherein the steel sheet is heated to a temperature in the range of 1200° F. to 1500° F. (648° C. to 816° C.) and while in this state it is locally hot deformed to facilitate the development of localized fine recrystallized grains in the vicinity of the areas of localized deformations to effect heat resistant domain refinement and core loss.

In pending U.S. patent application Ser. No. 07/977,595 and Ser. No. 07/978,202, both filed Nov. 17, 1992, respectively, and assigned to the same assignee of this patent application the use of a series of short body scribing rolls is disclosed, the rolls being arranged in at least two rows in a staggered pattern so as to scribe the entire transverse width of the strip. In one form the strip scribing projections of the scribing rolls are arrayed co-axially with the rolls and in another form they take a herringbone pattern.

In pending U.S. patent application Ser. No. 07/977,584, filed Nov. 17, 1992 and assigned to the same assignee of this patent application, the use of a very hard surface anvil roll is disclosed having a hardness that will prevent excessive twist that is imposed in the strip. Such strip movement is some times hereinafter referred to as "tracking" or "wandering". In the first case, the misdirected or wandering strip causes the reduction of strip feeding speed and in some instances, interruption of the process and in the other, unwinding and handling difficulty in processing the scribed strip during the manufacture of the transformers.

A problem with the mechanical scribing equipment known in the art is the very small range of acceptable variations in the tolerance for domain refinement. Thermal transients resulting in thermal expansions of machinery parts and the roll elements impose erratic variations that are more acute when the silicon steel strip is scribed while heated for example, to a temperature greater than 1000° F. (540° C.). At an elevated temperature of the strip, the combination of relatively high loading pressures and temperature during scribing cause objectionable distortion and deflection of both the scribing roll and the anvil roll.

In pending U.S. patent application Ser. No. 07/978,204, Filed Nov. 17, 1992, and assigned to the same assignee of this patent application, the use of a segmented scribing roll is used to scribe a surface of the strip while supported by a solid body anvil roll. The segmented scribing roll has an arbor used to support inflatable bladders so as to apply a uniform pressure for support of the segments forming the scribing roller.

While the above prior attempts have to different degrees met the basic objectives to which they were addressed, they have created other technical and practical problems some of which the present invention is designed to overcome. The present invention provides a new method and apparatus for overcoming each of the above enumerated problems, difficulties and objections.

It is an object of the present invention to provide an apparatus and a method wherein anvil segments of an anvil roller means are used to support a silicon steel strip during mechanical scribing for refining the magnetic domain wall spacing of the grain-oriented silicon steel strip. The anvil segments act to support the strip in a manner to assure the uniform mechanical deformation across the width of the steel strip by scribing ridges operating at a side of the strip opposite to the anvil segments.

It has been found that an anvil roll is needed to support a strip while a scribing roll contacts the strip for domain wall refinements of the electrical steel at the opposite side of a strip but non-uniform contact pressure with a scribing roll produced non-uniform scribing across the strip width. Generally, the scribing occurred with deeper penetrations at the center of the strip and with lighter, less penetration at the edges of the strip. This type of non-uniform scribing is believed to be the result of thermally induced crowning of the scribing and/or anvil rolls. However, non-uniform scribing may also be the result of non-uniform strip gage. The present invention seeks to provide uniform scribing through the use of a segmented anvil roller means to support the strip during the scribing operation. The anvil roller means, by this design, may utilize small width, ring-like anvil segments supported by an inflatable bladder to resiliently support the strip with uniform pressure. The bladder is supported in turn by an arbor that is rotatably supported to allow corresponding rotation of the anvil segments and assure continuous positioning with uniform pressure against the strip, including a corrective response to thermal crowning and strip gage variations.

SUMMARY OF THE PRESENT INVENTION

In accordance with the present invention there is provided an apparatus for refining the magnetic domain wall spacing of grain-oriented silicon steel strip, the apparatus comprising scribing roll means having scribing surfaces for imparting mechanical scribing to one surface of the strip during rolling contact therewith, a segmented anvil roller means for supporting the strip during scribing by the scribing roller means, the segmented anvil roller means further including means resiliently supporting the segments thereof for uniform support of the strip transversely the length thereof while engaged by the scribing roller means, and means for controlling the relative position of the segmented anvil roller and the scribing roll means at opposite sides of the strip to establish a rolling pressure contact area wherein the strip is scribed.

The means resiliently supporting the segments of the anvil roller means include a controllable fluid pressure chamber for load bearing support of all anvil segments. The scribing roll means has a scribing surface for engaging the strip surface across the width thereof.

The method of the present invention provides the steps of subjecting the strip to be scribed to a rolling contact pressure area formed while the strip is moving between a scribing roll and a rotatable segmented anvil roller, and imposing a uniform mechanical deformation transversely of the strip within the rolling contact pressure area by resilient support of anvil roller segments each having an outer peripheral strip engagement surface arranged such that upon rotation about a rotational axis of the anvil roller, the strip is supported by the anvil segments during contact at the oppositely directed strip surface by the scribing roll having surface projections to penetrate the surface of the strip while supported by the segmented anvil roller.

BRIEF DESCRIPTION OF THE DRAWINGS

The above and other objects and features of the invention will become more apparent from the following detail description taken in connection with the accompanied drawings which form a part of this specification and in which.

DETAILED DESCRIPTION OF THE PREFERRED EMBODIMENT

Figure 1:
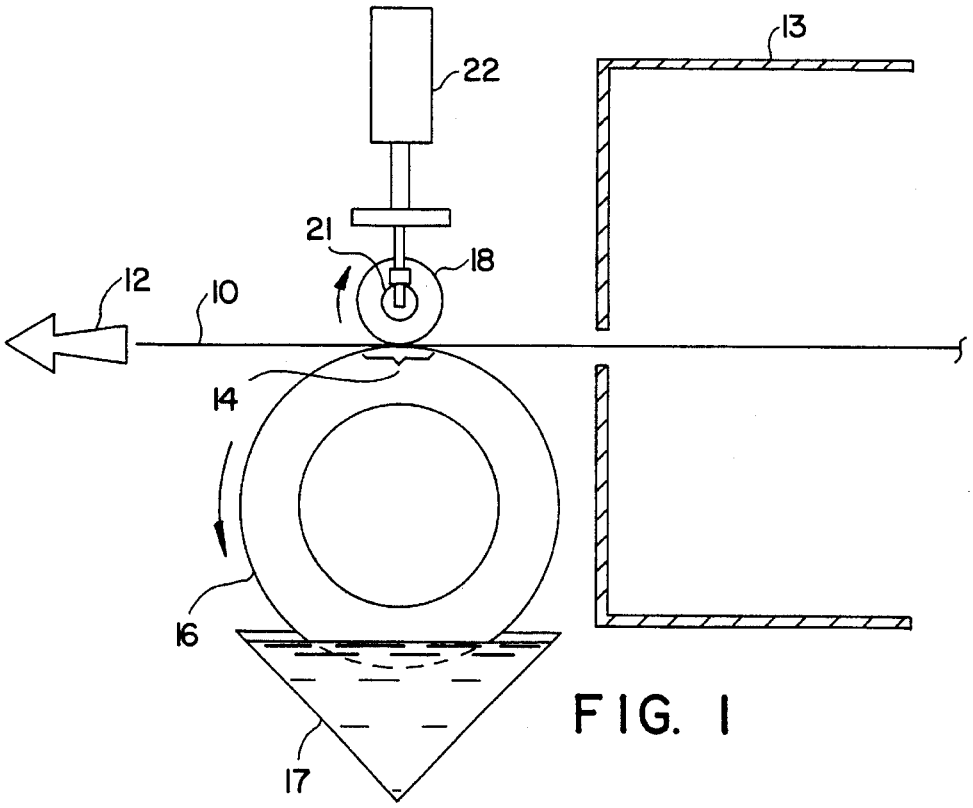
FIG. 1 is a side schematic elevational view of a preferred embodiment of an apparatus which is useful to carry out the method of the present invention.
Figure 2:
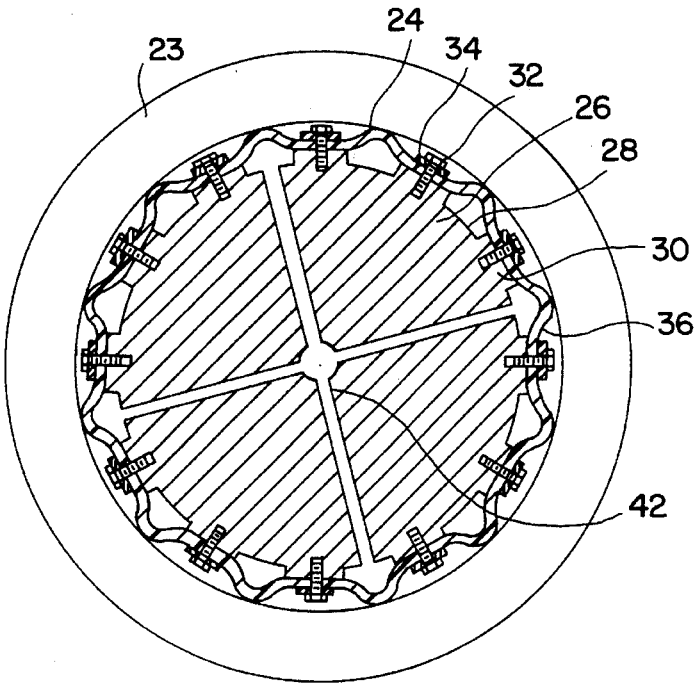
FIG. 2 is an enlarged sectional view taken transversely of the segmented anvil roll to illustrate the bladder support arrangement for the anvil segments.

With reference to FIG. 1, there is illustrated an apparatus which is useful to carry out the method for refining the magnetic domain wall spacing of electrical steels particularly grain-oriented silicon steel strip identified by reference numeral 10 by local mechanical deformation while the steel is relatively hot or cold but preferably, at an elevated temperature of at least about 1000° F. (540° C.), preferably at a temperature greater than 1200° F. (648° C.). The strip is advanced along a pass line in a suitable well known manner from a payoff reel thence through a furnace and after domain refinement by the present invention the strip is wound in a coil form by the mandrel of a coiler, of the kind also well known in the art. The method may be used in conjunction with other strip processing operations when desired, without departing from the teaching of the present invention.

Figure 4:
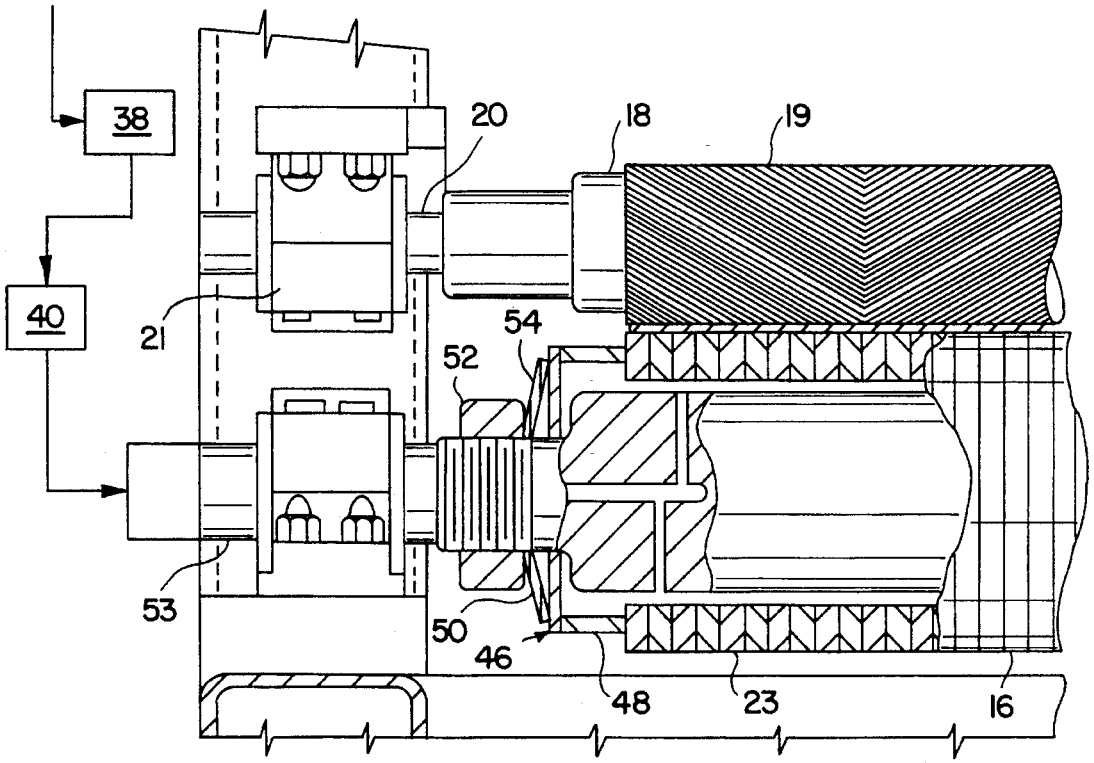
FIG. 4 is an isometric view of a segment forming part of a anvil roller of the present invention.

The strip advances along the pass line in the direction as indicated by arrow 12 from a furnace 13 for entry to a rolling contact pressure area 14 wherein the strip is simultaneously engaged at opposite sides by a segmented anvil roller 16 and a scribing roller 18. The scribing roller 18 is above the strip and the segmented anvil roller 16 is below the strip. It is preferred to cool the anvil roller by arranging a reservoir 17 containing a coolant, such as water, below the roller so as to allow the strip engaging parts of the roller to dip in the bath of coolant. This relation of the roller 16 and roll 18 to the opposite surfaces of the strip can be reversed without departing from the teachings of the present invention. As shown in FIGS. 1 and 4, the scribing roller has a body with protruding ridges 19 that are spaced apart to form scribed surfaces extending across the width of the strip. The scribing roller is provided with journals 20 at opposite ends of the roll body for support by bearing assemblies 21 that are in turn engaged with the rod ends of piston and cylinder assemblies 22.

Figure 3:
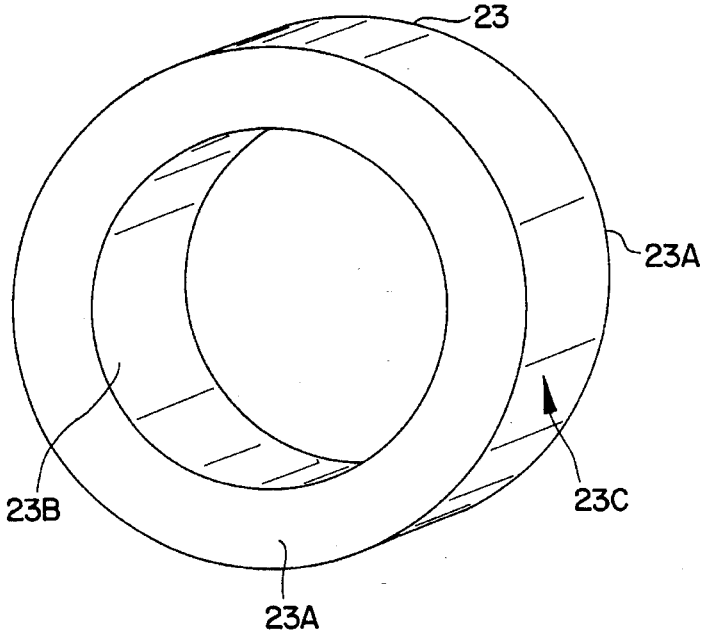
FIG. 3 is a partial longitudinal view in section through an end portions of a segmented anvil roller and a scribing roll.

As shown in FIGS. 1–4, the segmented anvil roll 16 includes a plurality of side-by-side segments 23. The anvil roll segments each comprise, as shown in FIG. 3, a ring or disk-like configuration formed by parallel side walls 23A extending from a central opening defined by an annular bore 23B to an annular external arbor face 23C having a smooth surface extending across the external face of the segment between the side walls 23A for support of a surface of the strip during scribing thereof.

The anvil segments 23 are arranged in a side-by-side manner for support by the bladder ribs 24 extending along the face of the arbor 26. The external body of the arbor is provided along the entire length with longitudinally extending grooves 28 that are formed by spaced apart interleaving ribs 30 about the entire periphery of the arbor. Bolts 32 passed through elongated keeper plates 34 threadedly engage in tapped holes each of the raised ribs to clamp a strip like section of a tubular shaped flexible bladder 36 to the arbor. Rubber or other elastomeric materials are suitable materials to form the bladder. A pressurized source 38 of a fluid medium such as air or liquid which can be water is controlled by valve 40 supplied to a bore 42 in the journal of the arbor for inflating the lengths of the bladder between the raised ribs of the arbor. The inflated bladder ribs 24 protrude radially from the arbor and form resilient support sites for the anvil segments 23. While anvil segments are supported by the bladder ribs and held in a side-by-side relation by the end fittings 46. Each fitting 46 has a cylindrical wall part 48 joined to an end wall 50 to press mutually engaged side walls of the segments 23 against one another. The pressing force is controlled by the torque applied to the nut member 52 while threadedly engaged with suitably located threads on a portion of the journal 53. The clamping force applied to the scribing segments is predetermined and maintained substantially uniform by placing spring-washers 54 between each end fitting 46 and nut member 52.

The scribe roll 18 and the segmented anvil roller 16 are positioned relative to one another at opposite sides of the strip by operation of the piston and cylinder assemblies 22 so that the scribing surfaces of the scribed roll engage the strip in the rolling contact area 14 to penetrate the surface of the strip causing scribe markings to refine the magnetic domain wall spacing. The pressure in the rolling contact area is applied uniformly across the width of the strip to maintain a critical tolerance to scribing pressure exerted by each anvil disk due to the uniform pressure of support for each disk by the bladder. The clamping force between the side walls of the ring or disk segments is not so great to preclude a desired relative position of the segments to accommodate crowning and changes to the crown of the scribing roll due to the temperature fluctuation of the scribing roll. It is preferred to provide an internal passage for a coolant in the segmented anvil roller to minimize thermal crown changes. Also, it is preferred to drive each of the scribing roll 18 and the segmented anvil roller 16 to match the speed of the strip engaging surfaces with the line speed of the strip caused by the coiling mandrel or allied machine affecting the speed of the strip along the passline.

The magnetic domain wall refining according to the present invention, is accomplished within very demanding tolerances necessary to operate on the domain wall spacings, such as a pitch on the order of 5–15 mm. During start-up operations and continuous scribing operations, all inherent thermal transients and expansion of machinery parts resulting therefrom, particularly when the steel strip is hot, are accommodated by the present invention. The resilient support for the anvil roll means arbor segments can be relied upon to support the strip during scribing by mechanical deformations across the strip and while advanced along the pass line.

Samples taken across the width of the strip at various sites, exhibited electrical properties which were measured. The use of the segmented anvil roll was found to improve scribing uniformity. Improved scribing uniformity results in improved magnetic property uniformity across the strip width which is highly valued by manufacturers who use this strip in transformer cores. The effect of the segmented anvil roll can be illustrated by examining the permeability across the scribed strip.

In order to illustrate the present invention, several samples of fully finished high permeability grain oriented silicon steel were domain refined using the process described in U.S. Pat. Nos. 5,080,326 and 5,123,988 mentioned above.

EXAMPLE I

Samples of such steel, having a 9 mil thickness and strip width of 4.7 inches (11.9 cm.) were mechanically scribed using a single scribing roll and a single solid anvil roll. The scribing roll had projections having a 5 mm pitch between projections and a 2.5 mil (0.0025 in.) and/or flat on the projection.

TABLE I

| Control Sample | Permeability μ10 | Scribed Sample | Permeability μ10 | μ10 Change |
|---|---|---|---|---|
| K4-1 | 1904 | K1-1 | 1862 | 42 |
| K4-2 | 1916 | K1-2 | 1881 | 35 |
| K4-3 | 1915 | K1-3 | 1893 | 22 |
| K4-4 | 1910 | K1-4 | 1895 | 15 |
| μ10 Range | 12 | | 33 | 27 |

As shown by the data, the permeability decreased as a result of the scribing, as expected. The range of permeability (μ10) changes over the 4.7 inch strip width was 15 to 42 points from unscribed to scribed material for a total of 27 points.

EXAMPLE II

Samples of high permeability steel, having a 9 mil thickness and strip width of 7.1 inches (18.0 cm) were mechanically scribed with the same parameters as Example I for the scribing roll. The anvil roll was segmented in accordance with this invention.

TABLE II

| Control Sample | Permeability μ10 | Scribed Sample | Permeability μ10 | μ10 Change |
|---|---|---|---|---|
| CJ9-1 | 1928 | CJ5-1 | 1922 | 6 |
| CJ9-2 | 1927 | CJ5-2 | 1914 | 13 |
| CJ9-3 | 1927 | CJ5-3 | 1912 | 15 |
| CJ9-4 | 1925 | CJ5-4 | 1912 | 13 |
| CJ9-5 | 1925 | CJ5-5 | 1912 | 13 |
| CJ9-6 | 1926 | CJ5-5 | 1902 | 24 |
| μ10 Range | 3 | | 20 | 18 |

As shown by the data of Table II, the steel scribed in accordance with the present invention showed better uniformity of response. The range of permeability over a wider strip was only 18 points. This range included the end samples which exhibited 6 and 24 point changes between scribed and unscribed samples. Without the end samples the permeability response was only 2 points. The present invention clearly demonstrates an improvement in permeability response with a segmented anvil roll.

Thus is can be seen from Tables I and II that the steels can be scribed more uniformly, by using a segmented anvil roll comprised of segments resting on an inflatable bladder which allows the roll to adjust to conditions of thermal crowing and gage variation.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. An apparatus for refining the magnetic domain wall spacing of grain-oriented silicon steel strip, said apparatus comprising:

scribing roll means having scribing surfaces for imparting mechanical scribing to one surface of the strip during rolling contact therewith, a segmented anvil roller means for supporting said strip during scribing by said scribing roller means, said segmented anvil roller further including anvil roller segments and means resiliently supporting the segments thereof for uniform support of the strip transversely of the width thereof while engaged by said scribing roll means;

means for arranging said anvil segments side-by-side under a clamping force sufficient to present anvil surfaces across the width of the strip and to permit relative positioning of the segments to accommodate crowning of the scribing roll means; and means for controlling the position of said segmented anvil roller means relative to said scribing roll means at opposite sides of said strip to establish a rolling pressure contact area wherein said strip is scribed.

2. The apparatus according to claim 1 wherein said scribing roll means includes a solid body having a strip scribing surfaces extending across the width thereof for mechanical deformation of the strip.

3. The apparatus according to claim 1 wherein said means for resiliently supporting the segments includes a controllable fluid pressure chamber for load bearing support of the segments.

4. The apparatus according to claim 1 wherein said means of resiliently supporting the segments include an arbor having a resilient support surface engageable with said segments to control the rolling pressure applied by said segments to the strip across the width thereof.

5. The apparatus according to claim 4 wherein said resilient support surface includes bladder ribs protruding radially from the arbor.

6. The apparatus according to claim 5 wherein said bladder ribs comprise inflatable lengths of an elastomeric bladder secured between raised ribs extending lengthwise of said arbor.

7. The apparatus according to claim 4 further comprising fluid supply means including a valve for supplying a fluid pressure medium to said bladder ribs to provide a uniform scribing pressure across the width of the strip.

8. The apparatus according to claim 1 wherein each of said segments has a disk-like configuration formed by parallel side walls extending from a central opening defined by an annular bore to an annular external face having smooth face defining an anvil surface.

* * * * *